United States Patent [19]

Minichiello

[11] 4,108,429

[45] Aug. 22, 1978

[54] SPRING TYPE EXERCISE DEVICE FOR BREAST MEASUREMENT DEVELOPMENT

[76] Inventor: Thomas Minichiello, 244 W. 49th St., New York, N.Y. 10019

[21] Appl. No.: 758,069

[22] Filed: Jan. 10, 1977

[51] Int. Cl.[2] ..... A63B 21/04

[52] U.S. Cl. ..... 272/136; 272/140; 272/134; 272/143

[58] Field of Search ..... 272/144, 138, 140, 145, 272/130, 67, 132, 135, 134, 118

[56] References Cited

U.S. PATENT DOCUMENTS

| | | | |
|---|---|---|---|
| 3,640,527 | 2/1972 | Proctor | 272/118 |
| 3,708,166 | 1/1973 | Annas | 272/118 X |
| 3,834,694 | 9/1974 | Pridgen | 272/118 |
| 3,912,261 | 10/1975 | Lambert | 272/118 |

FOREIGN PATENT DOCUMENTS

| | | | |
|---|---|---|---|
| 314,627 | 2/1934 | Italy | 272/140 |

*Primary Examiner*—William R. Browne

*Attorney, Agent, or Firm*—Nathaniel Altman

[57] ABSTRACT

An exercise device primarily for developing female breast measurement includes an upper-body support base upon which the exerciser, in a supine position, maintains her shoulders and upper back during use. A pair of rigid connecting members are symmetrically, pivotally and detachably mounted for rotation around the corners of the support base adjacent to the shoulders of the user. Attached to the outer end of each connecting member is a coil torsion spring which serves as a yieldably resistant hinge between the connecting member and a rigid exercise lever arm which normally extends upwardly and outwardly from the support base. A head support may be provided which is attached to and projects from the support base. Exercises are performed by the user grasping the two lever arms, pulling them against the action of the coil springs toward the center of the body, then permitting the lever arms to return to their original position, which may be directly beside the shoulders, directly above the shoulders, or any orientation intermediate thereof.

6 Claims, 8 Drawing Figures

SPRING TYPE EXERCISE DEVICE FOR BREAST MEASUREMENT DEVELOPMENT

BACKGROUND OF THE INVENTION

The size of the female breast is determined by such variables as heredity, pregnancy and lactation, total body weight, nutrition, and the body's hormone balance. The breast is composed mostly of fat plus the mammary glands, and no way is presently known to increase either of these tissues on demand, except by increasing total body weight. The woman who gains weight may also gain breast size, but at the expense of negating the attractive physical appearance for which the larger or more prominent breasts may be desirable.

Contrasted with and independent of breast size is the total breast measurement which includes the circumference of the chest and which can be changed, developed and increased through exercise. The total breast measurement is that which determines a woman's brassiere size (as opposed to cup size), and in comparision with waist and hip measurements popularly define body shape and attractiveness.

It is a recognized fact that the size of a muscle, as well as its strength and tone, can be increased through exercise, and that properly designed exercises performed on a regular schedule will help improve and enlarge the muscles more quickly. Thus, total breast measurement can be enhanced by exercise procedures directed to the two muscles related to and lying under the female breast—the pectoralis major and the pectoralis minor.

The pectoralis major is a broad thick triangular muscle at the upper and fore part of the chest which assists in drawing the shoulder forward and rotating the arm inward; the pectoralis minor is a thin flat triangular muscle, situated at the upper part of the thorax under the pectoralis major, which assists in drawing the shoulder forward and downward. In any position, if the arm is held rigid at the elbow joint, these two muscles are used almost exclusively in moving the shoulder and the arm. When these two muscles are exercised and increased in size, the resulting thickening also increases the total breast dimension.

It is also a recognized fact that a program of regular, properly designed exercise has both specific and general advantages which can positively affect the total breast measurement. Among the general benefits are better circulation, body tone, stamina, well being an overall improvement of health and attitude. Among the specific benefits of exercise are better posture and carriage which results from both physiological and psychological stimuli; when a woman stands and walks more erectly and proudly, her total breast measurement and appearance both increase.

In using most presently available exercise equipment or following exercise procedure without proper supervision and guidance, a great deal of exercise effort goes to waste, is misdirected or badly performed. Coaching is required to assure the best results from exercise, and to monitor against physical strain or accident resulting from misuse of equipment or poor exercise performance.

Prior art devices for developing the female breast through exercise specifically concentrating on the pectoralis muscles are primarily of hand-held design, with their resistances directed toward compressing or expanding their individual parts. In either instance, the value of the exercise is severely limited, since the range of movement in a hand-held device of this type is comparatively small, not permitting the muscles to move from full relaxation to full flexion and back again. Moreover, hand-held devices are neither comfortable to hold nor safe, since they operate by the action of compression or tension springs; they must be released completely before the user can put them down without possibility of injury.

When weightlifting devices are used for exercising the two pairs of pectoralis muscles, they normally bring into use other muscles of the arms, shoulders, neck and back, developing them in strength, shape and size. This type of development preferred for male physique is usually both inappropriate and undesirable for female appearance and attractiveness.

Even those conventional weight-lifting devices designed for more general exercise patterns such as hand-held bars or dumbells have the disadvantages of the relatively high degree of exertion required for their use, the possibility of accident or injury through misuse; other weight-lifting devices operating through pulleys require mounting on rigid stand, wall or other support.

Taking into account all of the above information, the ideal exercise device for improving total breast measurement should provide the following features and benefits:

1. Its use should exercise the pectoralis major and minor muscles as exclusively as possible, and through the fullest possible range of positions and motions.
2. Its inherent construction should facilitate exercising in the prescribed manner, and should make it all but impossible to perform the exercise incorrectly or for the user to strain, over exert, or injure herself in use.
3. It should provide a range of adaptability to a user's changing strength and physical growth, serve to maintain optimum development after it has been reached, and allow for maximum benefit from each use.
4. It should be simple to assemble, set up and use so as to encourage exercizing as regularly as prescribed; comfortable to use; easy to store; smooth in operation, attractive, and ruggedly constructed for long-lasting effective use.

SUMMARY OF THE INVENTION

The exercise device of the present invention meets all of the requirements outlined above. Its concept is a direct adaptation of the proven principles of weight lifting, substituting torsion spring resistance for the resistance of weight, and its operation is particularly adapted to the lesser physical strength of females and to safer use by those who are inexperienced in exercise techniques.

Specifically, the exercise device herein disclosed includes a support base for the upper body, a pair of rigid connecting members pivotally mounted on the support base for rotation, and a pair of rigid exercise lever arms hingedly connected to the connecting members by a pair of coil springs, the resistance of which is directed at right angles to the coils.

The device is used placed flat on the floor, with the exerciser's shoulders and upper back resting upon the support base, which is preferably inclined upwardly so that the shoulders and head are somewhat raised relative to the lower body. An extension of the support base may be included to provide neck and head support. Because of the pivotal mounting of the connecting members, the two lever arms may be positioned either directly beside the shoulders, requiring the user to reach outwardly in order to grasp each exercise lever arm; or these lever arms may be disposed directly behind the shoulders, approximately 90° from the first position and necessitating a reach over and behind the head; or any location intermediate of the two above-mentioned may be used as an exercise starting position. In each instance, the user grasps the outwardly disposed lever arms from underneath with her own arms fully extended and pulls inwardly toward the center of her body against the resistance of the torsion coil springs; she continues to pull inwardly as far as her strength and condition permit, then allows the exercise lever arms to return to their original outwardly extending starting position. This exercise cycle is repeated as many times and from as many starting positions as prescribed for the individual exerciser.

The physical action of these exercises concentrates almost entirely on the two pairs of pectoralis muscles, to strengthen and enlarge them in response to the number of times per session and the regularity of the schedule by which they are performed. Since the device requires that the user's arms be kept extended without movement at the elbow joint, the exercise movements must be accomplished almost entirely by the pectoralis muscles rather than those of the arm or shoulder.

The movement from arms outspread to arms together exercise the muscles more completely than any device or method which does not allow complete extension and flexion. Since the device of this invention permits the exercises to be performed through a full arc of 90° of start/finish positions, every portion of the pairs of pectoralis muscles can be shaped and strengthened and any imbalance in muscular development may be corrected.

Since the user is still working against the resistance of the torsion coil springs during the second part of each exercise, when the lever arms arc returning to their outward position, the action of the muscles must be maintained at its greatest possible tension until the point of full relaxation is reached. This provides the same exercise benefits which weights produce and are recognized for, but without the degree of physical exertion or the possibility of accident or injury which hand-held bars, dumbbells or other devices can present.

Although different kinds of springs—comprehension or tension—have been used in prior art exercise devices, no application has been made previously of either the coiled torsion springs or the principle of leverage available when the operation of the spring's resistance is applied through the use of an extended lever arm. Springs of proper resistance would be all but impossible to flex without the lever-arm force advantage. Use of the device of this invention in a supine position provides the same movements which come from weight-lifting, at the same time permitting the user to hold it in place with her own body weight and eliminating any need for any attachment.

The exercise device of this invention offers safety in use which similar purpose devices have all but ignored. Since it is used on the floor, it cannot be dropped or slip from the hands. The springs are not exposed in such a way that the user can receive injury to her body or clothing. The device is held in place by the user's own weight of chest, shoulders and head. Since the user can pull the lever arms no farther inwardly than her own strength permits, she cannot overexert herself. Even if the exerciser should suddenly need to release a flexed arm of the device during an exercise cycle, the lever arm will simply retract away from the user's arms and body, without likelihood of injury. Finally the supine position of use is ideal, particularly for a female, for comfort and for exerting the full flexion-relaxation range of her pectoralis muscles.

Specific constructions and concepts of the best modes of this invention now contemplated will be described more fully in connection with the accompanying drawings, in which:

DRAWINGS

DESCRIPTION OF THE PREFERRED EMBODIMENTS

Figure 1:
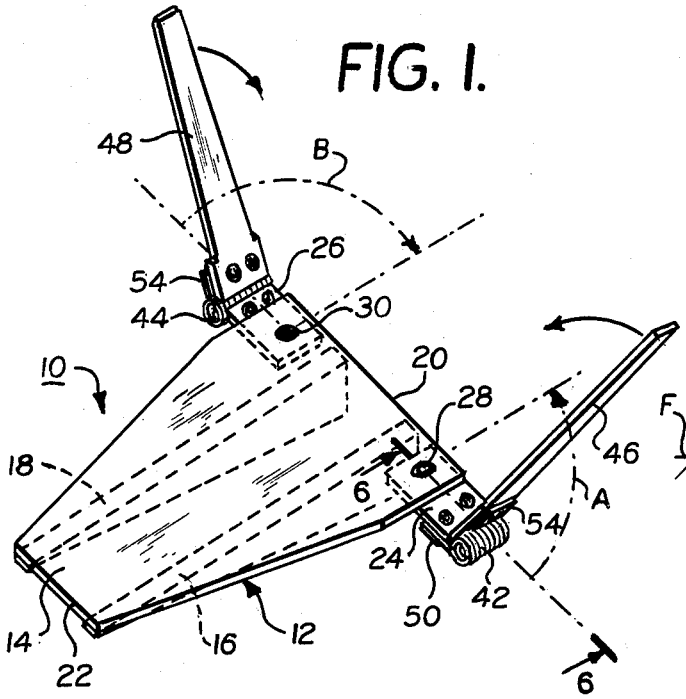
FIG. 1 is an isometric view of a preferred embodiment of the exercise device of this invention, with its exercise lever arms in side position.
Figure 2:
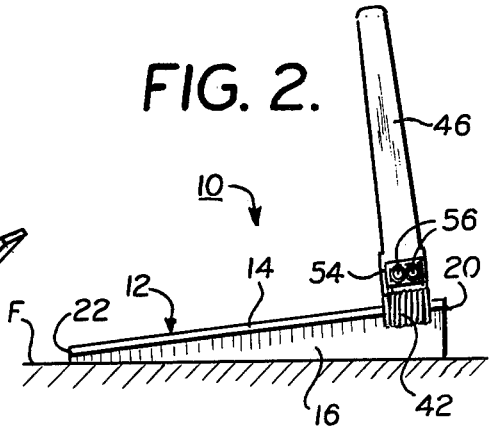
FIG. 2 is a right side view of the device of FIG. 1.
Figure 3:
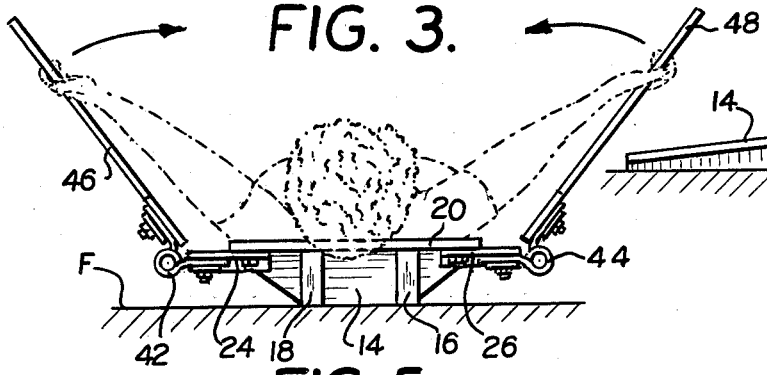
FIG. 3 is a rear view thereof, with an exerciser shown in phantom prepared to begin an exercise.

FIG. 1 illustrates a basic preferred embodiment of the exercise apparatus generally designated as 10. with support base 12 shown comprising a substantially flat platform 14 affixed to and support by a pair of wedge-shaped elements 16 and 18, converting platform 14 into an inclined shoulder and upper back support, with its shoulder supporting or rear end 20 somewhat higher than front end 22.

Figure 6:
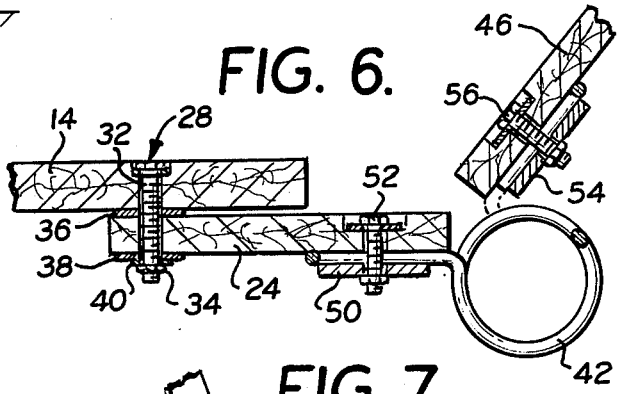
FIG. 6 is a partial sectional view taken along line 6—6 of FIG. 1, illustrating the mounting details of the components of the device.

One end of each connecting member 24 and 26 is detachably mounted for rotation under platform 14 on pivots 28 and 30 respectively. Pivot construction details are illustrated in FIG. 6, where pivot 28 is shown comprising bolt 32, nut 34, anti-friction washers 36 and 38, and lock washer 40. Pivot 30 may be of identical construction, and each pivot permits free rotation of its respective connecting member from the position shown in FIGS. 1, 2, 3, and 6 to any point along the respective dot-dash arcs A and B of FIG. 1.

The outer end of each connecting member 24 and 26 carries a coil torsion spring 42 and 44 respectively, which in turn yieldingly support exercise lever arms 46 and 48 in hinge-like fashion. As best seen in FIG. 6, each spring is secured at one end to its associated connecting member by holding plates 50 in cooperation with bolts 52; and the opposite end of each spring is similarly secured to its respective exercise lever arm by holding plates 54 and bolts 56. As may be clearly seen in the drawings, the exercise lever arms 46 and 48 are held extending upwardly and outwardly from support base 12.

Figure 4:
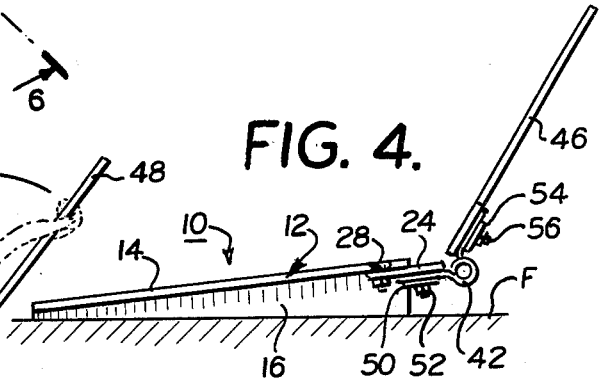
FIG. 4 is a right side view similar to FIG. 2, but with the exercise lever arms in rear position.
Figure 5:
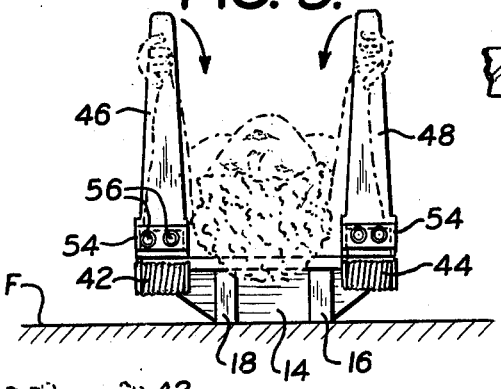
FIG. 5 is a rear view of the device in the position of FIG. 4.

In use, exercise device 10 is placed on floor F. and the user positions herself with her shoulders and upper back disposed on platform 14, holding it in place with her own weight. The starting position of the exercise lever arms may be that side orientation of FIGS. 1, 2 and 3; the rear orientation of FIGS. 4 and 5; or any intermediate position. In any case, the exerciser grasps the lever arms from underneath, extending her own arms as far as their length allows, and pulls downwardly and inwardly against the coil torsion springs in the direction of the solid arrows shown in FIGS. 1, 3, and 5; when the limit of her strength is reached, the lever arms, still in her grasp, are permitted to return to their original starting position.

Figure 7:
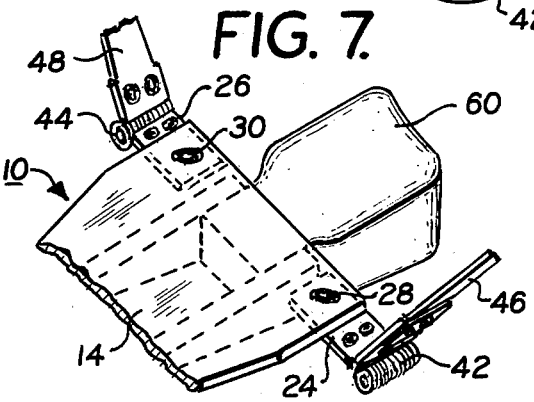
FIG. 7 is a partial isometric view of a modified form of the invention.
Figure 8:
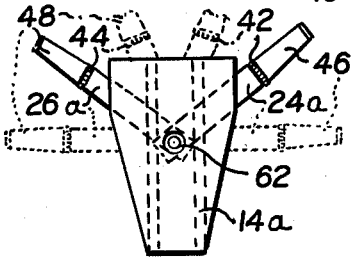
FIG. 8 is a top plan view of still another embodiment of the novel exercise device.

As FIG. 7 shows, exercise device 10 may be augmented with head support 60 extending rearwardly from support platform 14. FIG. 8 illustrates a modified form of the exercise device wherein connecting arms *24a* and *26a* are mounted for rotation in overlying relationship to each other on support platform *14a* by a single centrally disposed pivot 62. The respective lever arms 46 and 48 and resistant hinge-coil springs 42 and 44 correspond in all respects to the above-described embodiment.

It should be noted that storage of device 10 when not in use is facilitated by its easy disassembly accomplished by removing bolts 32 of pivots 28 and 30.

Various modifications of device 10 may be made without departing from the essence or spirit of this invention. For example, platform 14, which may be fashioned of wood, plywood, fiberglass or plastic, can be contoured to fit upper back, and may be provided with suitable padding or cushioning. The coil torsion springs 42 and 44 may be provided with standard resistance characteristics to permit long usage by the average exerciser, or stronger replacement springs may be supplied for the more experienced, better-conditioned user.

I claim:

1. A device for exercising female pectoral muscles to achieve breast measurement development, which comprises:

support base means for positioning the supine body of the exerciser so that said base support means accomodates the shoulders and upper back of the exerciser and is held in place on the floor by the weight of the exerciser;

a pair of rigid connecting members attached to the base means and extending outwardly beyond said base means;

pivot means for mounting said pair of connecting members each independently rotatable in a substantially horizontal plane on said support base means to selectively position the connecting members in a plurality of horizontal positions;

a pair of rigid exercise lever arms attached to said connecting members; and a pair of yieldable spring resistant hinge means for connecting each of said pair of exercise lever arms to each of said connecting members so that said lever arms extend biasedly upward and outward from said support base means, each said pair of yieldable spring resistant hinge means being positioned substantially adjacent to one shoulder of the exerciser, permitting the rxerciser, in a reclined position with her back on the base means and her arms fully extended, so as to be capable of grasping each of said lever arms, to pull inwardly toward the body's center as far as possible against the biasing force of said yieldabl spring resistant hinge means, then to allow said lever arms to return to their outwardly extending starting position under action of the hinge means, the body motions involved being produced by the full flexion and extension of the pectoral muscles substantially alone.

2. An exercise device as in claim 1, wherein said support base means comprises a platform means for supporting the upper back and shoulders of the exerciser and support means for maintaining said platform means in an inclined position relative to the floor, so that the shoulder-supporting end of said support base means is higher than its opposite end.

3. An exercise device as in claim 1, wherein said support base means further comprises a head support, attached to and extending from the shoulder-supporting end of said support base means.

4. An exercise device as in claim 1, wherein said pivot means hold said pair of connecting members symmetrically and detachably to said support base means and permit each assembly of said connecting members, said hinge means, and said exercise lever arms to be positioned selectively anywhere along an arc of at least 90° between a location directly beside and a location directly behind the shoulders of the exerciser.

5. An exercise device as in claim 1, wherein said pivot means is a single pivot rotatably holding both of said connecting members in overlying relationship.

6. An exercise device as in claim 1, wherein said yieldably resistant hinge means is a pair of coil torsion springs, the resistance of each of which is exerted at a right angle to the longitudinal axis of said coil spring, so that the exerciser, in exerting inward and downward pressure against said exercise lever arms attached to said coil spring hinge means is pulling against the yieldable resistance of said hinge means.

* * * * *